US008096081B2

(12) United States Patent
Sees

(10) Patent No.: US 8,096,081 B2
(45) Date of Patent: Jan. 17, 2012

(54) JAMB LINER FOR A WINDOW ASSEMBLY

(75) Inventor: Benjamin R. Sees, Pella, IA (US)

(73) Assignee: Pella Corporation, Pella, IA (US)

( * ) Notice: Subject to any disclaimer, the term of this patent is extended or adjusted under 35 U.S.C. 154(b) by 1994 days.

(21) Appl. No.: 11/034,171

(22) Filed: Jan. 12, 2005

(65) Prior Publication Data

US 2006/0150519 A1 Jul. 13, 2006

(51) Int. Cl.
*E05D 15/16* (2006.01)

(52) U.S. Cl. ..... 49/428; 49/429; 49/454; 49/504

(58) Field of Classification Search ..... 49/415, 49/428, 429, 454, 504
See application file for complete search history.

(56) References Cited

U.S. PATENT DOCUMENTS

| | | | | | |
|---|---|---|---|---|---|
| 137,572 | A | * | 4/1873 | Smith | 49/428 |
| 624,944 | A | * | 5/1899 | Jones | 49/428 |
| 722,305 | A | | 3/1903 | Hultmark | |
| 818,703 | A | * | 4/1906 | McGinnis | 49/174 |
| 888,657 | A | * | 5/1908 | Sanders | 49/172 |
| 926,735 | A | | 7/1909 | Gould | |
| 971,261 | A | | 9/1910 | Frisbee | |
| 1,038,160 | A | | 9/1912 | Leonard | |
| 1,113,157 | A | | 10/1914 | Forsyth | |
| 1,302,480 | A | * | 4/1919 | Soule | 49/452 |
| 1,559,502 | A | | 10/1925 | Campbell | |
| 1,632,789 | A | | 6/1927 | Domscheit | |
| 1,728,344 | A | | 9/1929 | Hellstrand | |
| 1,842,242 | A | | 1/1932 | Bolles | |
| 1,953,743 | A | | 4/1934 | Burrell | |
| 2,187,459 | A | | 1/1940 | Lorenz | |
| 2,310,401 | A | * | 2/1943 | Dautrick et al. | 49/454 |
| 2,343,446 | A | * | 3/1944 | Dautrick | 49/415 |
| 2,397,090 | A | * | 3/1946 | Dautriek et. al. | 49/415 |
| 2,426,474 | A | * | 8/1947 | Trammell, Sr. et al. | 49/209 |
| 2,593,239 | A | | 4/1952 | Anderson | |
| 2,595,419 | A | * | 5/1952 | Smith | 49/423 |
| 2,719,342 | A | | 10/1955 | Hunt | |
| 2,766,860 | A | | 10/1956 | Travis | |
| 2,778,069 | A | * | 1/1957 | Starck et al. | 49/422 |
| 2,843,233 | A | * | 7/1958 | Walsh | 49/431 |
| 2,876,506 | A | | 3/1959 | Knebel | |
| 2,912,077 | A | | 11/1959 | Walsh | |

(Continued)

FOREIGN PATENT DOCUMENTS

| | | |
|---|---|---|
| AU | 220004 | 5/1958 |

(Continued)

*Primary Examiner* — Katherine Mitchell
*Assistant Examiner* — Catherine A Kelly
(74) *Attorney, Agent, or Firm* — Faegre & Benson LLP

(57) ABSTRACT

The present invention is directed to a double hung window assembly and methods of manufacturing the double hung window assembly. The window assembly includes upper and lower sash assemblies, opposing side jambs, and a pair of opposing jamb liners that each have a length generally equal to a length of the opposing side jambs. At least one jamb recess is located between sash tracks on each of the jamb liners. Each jamb recess retains a jamb filler having a length generally equal to the jamb liner length. Each jamb filler has outer and inner weather stripping recesses, and outer and inner weather stripping. The jamb filler may include a primary exposed surface that is substantially unobstructed by the inner and outer weather stripping. A portion of the outer and inner weather stripping may be compressively secured between the jamb filler and a portion of the jamb liner.

29 Claims, 4 Drawing Sheets

U.S. PATENT DOCUMENTS 2,943,345 A 7/1960 Ammerman
3,114,179 A 12/1963 Briggs
3,145,433 A * 8/1964 Jones ..... 49/414
3,203,053 A 8/1965 Lane et al.
3,269,062 A * 8/1966 Mears, Jr. ..... 49/505
3,374,821 A 3/1968 White
3,461,608 A 8/1969 Johnson
3,562,954 A 2/1971 Duguay
3,667,179 A * 6/1972 Eisenberg ..... 52/209
3,676,956 A 7/1972 Taylor et al.
3,717,887 A 2/1973 Thomas
3,724,136 A 4/1973 Forsberg
3,842,564 A 10/1974 Brown
3,940,898 A 3/1976 Kaufman
4,004,389 A 1/1977 DiFazio
4,012,878 A 3/1977 Ellingson
4,034,510 A 7/1977 Huelsekopf
4,034,514 A 7/1977 Cecil
4,128,967 A 12/1978 Kirsch
4,257,202 A * 3/1981 Biro ..... 52/204.51
4,266,387 A 5/1981 Karlsson
4,299,060 A 11/1981 Tippmann
4,307,542 A 12/1981 Lense
4,454,687 A 6/1984 Baker
4,470,222 A 9/1984 Killingsworth
4,538,380 A 9/1985 Colliander
4,563,381 A 1/1986 Woodland
4,569,154 A * 2/1986 Bayer ..... 49/504
4,583,639 A 4/1986 Fedick et al.
4,712,330 A 12/1987 Beirnes
4,720,936 A 1/1988 Ellingson
4,726,148 A 2/1988 Tix
4,891,921 A 1/1990 Governale
4,944,118 A * 7/1990 Biro ..... 49/504
5,081,793 A * 1/1992 Mauro ..... 49/501
5,099,624 A * 3/1992 Valentin ..... 52/207
5,199,219 A 4/1993 Martini et al.
5,245,788 A 9/1993 Riegelman
5,265,308 A * 11/1993 May et al. ..... 16/197
5,339,583 A * 8/1994 Hrdlicka et al. ..... 52/204.53
5,375,376 A 12/1994 Scott
5,414,962 A * 5/1995 Forbis et al. ..... 49/454
5,491,940 A * 2/1996 Bruchu ..... 52/213
5,515,652 A * 5/1996 Klimek ..... 49/501
5,526,608 A 6/1996 Stark
5,566,507 A 10/1996 Schmidt et al.
5,575,116 A 11/1996 Carlson et al.
5,581,951 A 12/1996 Ryan et al.
5,603,585 A * 2/1997 Bruchu et al. ..... 403/382
5,671,566 A * 9/1997 Tix et al. ..... 49/419
5,675,937 A 10/1997 Stebel
5,687,519 A * 11/1997 Bruchu ..... 52/213
5,699,636 A 12/1997 Stark
5,836,118 A * 11/1998 Thornton et al. ..... 52/204.1
5,866,054 A 2/1999 Dorchester et al.
5,896,532 A 4/1999 Bleweett
5,934,031 A 8/1999 DeNormand
6,055,782 A 5/2000 Morton et al.
6,122,864 A * 9/2000 Martin ..... 49/428
6,141,913 A 11/2000 Wong et al.
6,305,126 B1 * 10/2001 Hendrickson et al. ..... 49/456
6,308,487 B1 10/2001 Cantley
6,470,643 B1 10/2002 Cantley
6,588,150 B1 7/2003 Wong et al.
6,675,537 B2 * 1/2004 Morton et al. ..... 49/504
6,679,004 B1 * 1/2004 Olberding et al. ..... 49/460
6,684,571 B2 * 2/2004 Hendrickson et al. ..... 49/428
6,722,082 B1 4/2004 Peterson et al.
6,826,871 B2 * 12/2004 Morton et al. ..... 49/504
6,883,276 B1 4/2005 Hannan et al.
7,228,660 B2 * 6/2007 Rhode et al. ..... 49/428
2002/0023387 A1 2/2002 Hendrickson et al.
2004/0139659 A1 * 7/2004 Hendrickson et al. ..... 49/428

FOREIGN PATENT DOCUMENTS

CA 0605391 9/1960

* cited by examiner

JAMB LINER FOR A WINDOW ASSEMBLY

FIELD OF THE INVENTION

The present invention relates to an aesthetically appealing window jamb liner mountable in the side jambs of a double hung window for securing window sash assemblies.

BACKGROUND OF THE INVENTION

In a double hung window, the window sashes are typically secured to a window frame by window jambs located on the sides of the window frame. Window jambs also function to create a seal between the window sash and the window frame to prevent moisture from leaking into the interior of the window frame when the window is closed. This sealing function is particularly important in double hung window assemblies where an upper sash and a lower sash can be moved up and down to either open or close the window.

Though many window jambs adequately secure and seal window sashes to the window frame, little attention has been focused on the appearance of window side jambs until recently. To some purchasers of window frames and sashes, the appearance of a window can be as equally important as how well it functions. Unfortunately, an appealing appearance is often lacking in most side jambs, mostly due to the portion of the side jamb known as the jamb liner.

The jamb liner is the component of the side jambs that provides many of the functional aspects of a window jamb, including forming sash tracks in which the window sashes can vertically slide to open and close the window. In a double hung window, the sash tracks for the two window sashes are separated on each side by the jamb liner. Therefore, the jamb liner, and particularly the piece of the jamb liner that separates the sash tracks, plays a large role in the overall appearance of a window assembly. Despite this, jamb liners are often extruded from a piece of metal or plastic and therefore do not match or even blend in with the rest of the inner portions of the window frame which is often made of wood.

Other attempts have been made to design a window assembly that provides an aesthetically appealing window jambs. U.S. Pat. No. 6,305,126 (Hendrickson et al.) describes a window jamb component assembly mountable in a jamb of a double hung window that includes a jamb liner having upper and lower segments, channel guides spaced apart by a profiled web, and upper and lower sash assemblies. The profiled web defines a jamb filler recess, an inner weather stripping recess and an outer weather stripping recess.

The jamb fillers that are retained by each of the jamb filler recesses each have a length substantially the same as the length of one of the window sash assemblies. Therefore, each jamb recess typically contains an upper and a lower jamb filler. The frame weather stripping is secured to the window assembly via weather stripping recesses located in the profiled web.

U.S. Pat. No. 6,122,864 (Martin) describes a window assembly that includes a jamb filler that extends the full height of the jamb liner. A weather-strip is attached to substantially the entire exposed surface of the jamb filler.

BRIEF SUMMARY OF THE INVENTION

It is the object of the present invention to provide a window assembly for a double hung window that includes an aesthetically appealing jamb liner that functions to secure window sash assemblies in a window frame and to seal moisture out of the interior of the window frame when the window is closed.

The present invention is directed to a double hung window assembly that includes upper and lower sash assemblies each having a sash height, opposing side jambs, a pair of opposing jamb liners that have a jamb liner length generally equal to a length of the opposing side jambs. Sash tracks are located on each of the jamb liners securing the upper and lower assemblies to the opposing side jambs. At least one jamb recess is located between the sash tracks on each of the jamb liners. The double hung window assembly also includes a pair of jamb fillers each having a length generally equal to the jamb liner length and retained in each of the jamb recesses. Each jamb filler has an outer weather stripping recess and an inner weather stripping recess. An outer weather stripping, having a length generally equal to the height of the upper sash assembly, is attached in the outer weather stripping recess. An inner weather stripping, having a length generally equal to the height of the lower sash assembly, is attached in the inner weather stripping recess. In one embodiment, the jamb filler also includes a primary exposed surface that is substantially unobstructed by the inner and outer weather stripping. In another embodiment, a portion of the outer and inner weather stripping is compressively secured between the jamb filler and a portion of the jamb liner.

In one embodiment the jamb fillers of the window assembly are releasably attached to the jamb recesses. In another embodiment the jamb fillers form a compressive relationship with the jamb recesses.

Preferably, the jamb filler of the window assembly substantially fills the jamb recess. In one embodiment, the jamb filler is formed of substantially the same material as an inner trim of the window assembly. In another embodiment, the jamb filler is formed of wood.

Preferably the inner and outer weather stripping recesses are generally parallel to the primary exposed surface of the jamb filler. In one embodiment, the inner and outer weather stripping recesses are located along a side edge of the jamb filler. The inner and outer weather stripping recesses generally may be perpendicular to a pull direction along which the weather stripping is removed. In another embodiment, the inner weather stripping recess is located in a lower portion of the jamb filler. And in still another embodiment, the outer weather stripping recess is located in an upper portion of the jamb filler.

In one embodiment a portion of the outer and inner weather stripping is compressively secured between the jamb filler and a portion of the jamb liner. In another embodiment a portion of the outer and inner weather stripping is trapped between the jamb filler and a portion of the jamb liner. In still another embodiment, the inner and outer weather stripping can not be removed from the jamb filler unless the jamb filler is removed from the jamb recess.

In one embodiment, a protective cover is attached to the jamb filler along a lower portion of the jamb filler and has a length generally equal to the height of the lower sash. In another embodiment, the protective cover is substantially similar in appearance to an outer trim of the window assembly. In still another embodiment the protective cover is formed from one of plastic cladding, aluminum cladding, paint, polyurethane, and stain.

The present invention is also directed to a method of manufacturing a double hung window assembly. In one step of the invention a pair of opposing jamb liners is positioned in opposing side jambs of the window assembly. Each jamb liner has a length generally equal to a length of the opposing side jambs. In another step of the invention, upper and lower sash assemblies, each having a sash height, is positioned in sash tracks formed in the opposing jamb liners. In still another step of the invention, a pair of jamb fillers is provided. Each jamb filler has a length generally equal to the jamb liner length and has an outer weather stripping recess and an inner weather stripping recess. In yet another step of the invention, an outer weather stripping having a length generally equal is attached to the height of the upper sash assembly to the outer weather stripping recess. In another step, an inner weather stripping having a length generally equal to the height of the lower sash assembly is attached to the inner weather stripping recess. The jamb filler comprises a primary exposed surface that is substantially unobstructed by the inner and outer weather stripping. In still another step, the jamb liner is releasably secured in a jamb recesses located between the sash tracks on each of the jamb liners.

In one embodiment of the method of manufacturing a window assembly, the method further includes the step of compressively engaging the jamb filler with the jamb recess.

Preferably, the inner and outer weather stripping recesses are formed generally parallel to the primary exposed surface of the jamb filler. In one embodiment, the method includes the step of forming the inner and outer weather stripping recesses generally perpendicular to a pull direction along which the weather stripping is removed.

In one embodiment, the method further includes the step of compressively securing a portion of the outer and inner weather stripping between the jamb filler and a portion of the jamb liner. In another embodiment, the inner weather stripping is located only along a lower portion of the jamb filler. In still another embodiment, the outer weather stripping is located only along an upper portion of the jamb filler.

The method of the present invention may include the step of removing the jamb filler from the jamb recess before removing the inner and outer weather stripping from the jamb filler.

Preferably, the method includes the step of attaching a protective coating to a lower portion of the jamb filler along a length generally the height of the lower sash. In one embodiment, the step of attaching a protective coating further includes the step of forming the protective coating with substantially the same appearance to outer trim of the window assembly. In another embodiment, the step of attaching a protective coating further includes the step of forming the protective from one of plastic cladding, aluminum cladding, paint, polyurethane, and stain.

The window assembly of the present invention provides for window jambs that impart a visually pleasing finish to the side jambs while functioning to secure window sash assemblies to the window assembly and to seal moisture out of the interior of the window assembly when the window is closed.

DETAILED DESCRIPTION OF THE INVENTION

Figure 1:
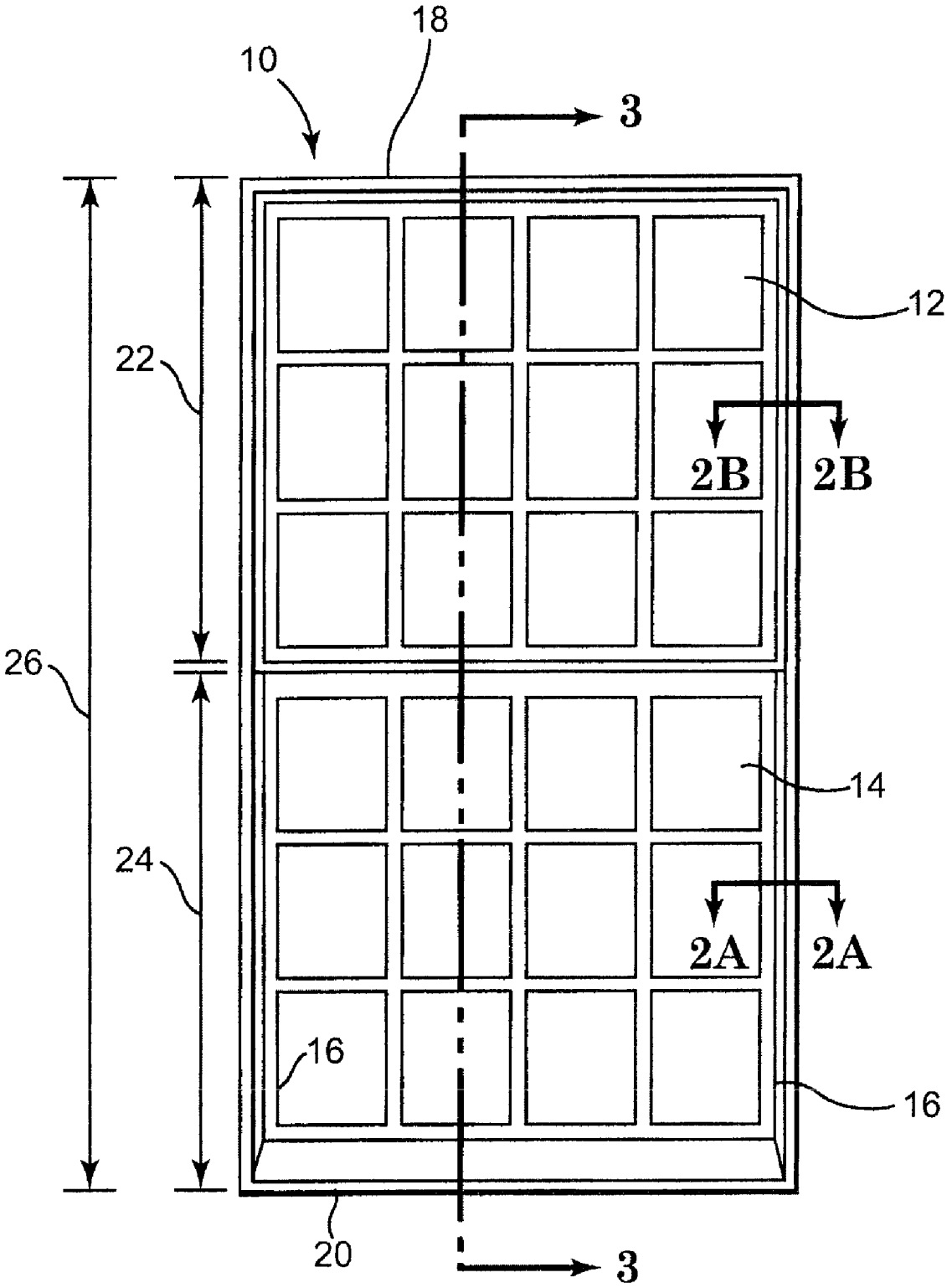
FIG. 1 illustrates a perspective view of a window assembly in accordance with the present invention.

FIG. 1 illustrates a double hung window assembly 10 with a side jambs 16 in accordance with the present invention. Upper sash assembly 12 and lower sash assembly 14 are each supported by opposing side jambs 16, a header jamb 18 and a sill 20 opposite the header jamb 18. The lower sash assembly 14 is supported for sliding vertical movement along the opposing side jambs 16. The upper sash assembly 12 has an upper sash height 22 and the lower sash assembly 14 has a lower sash height 24.

Figure 2A:
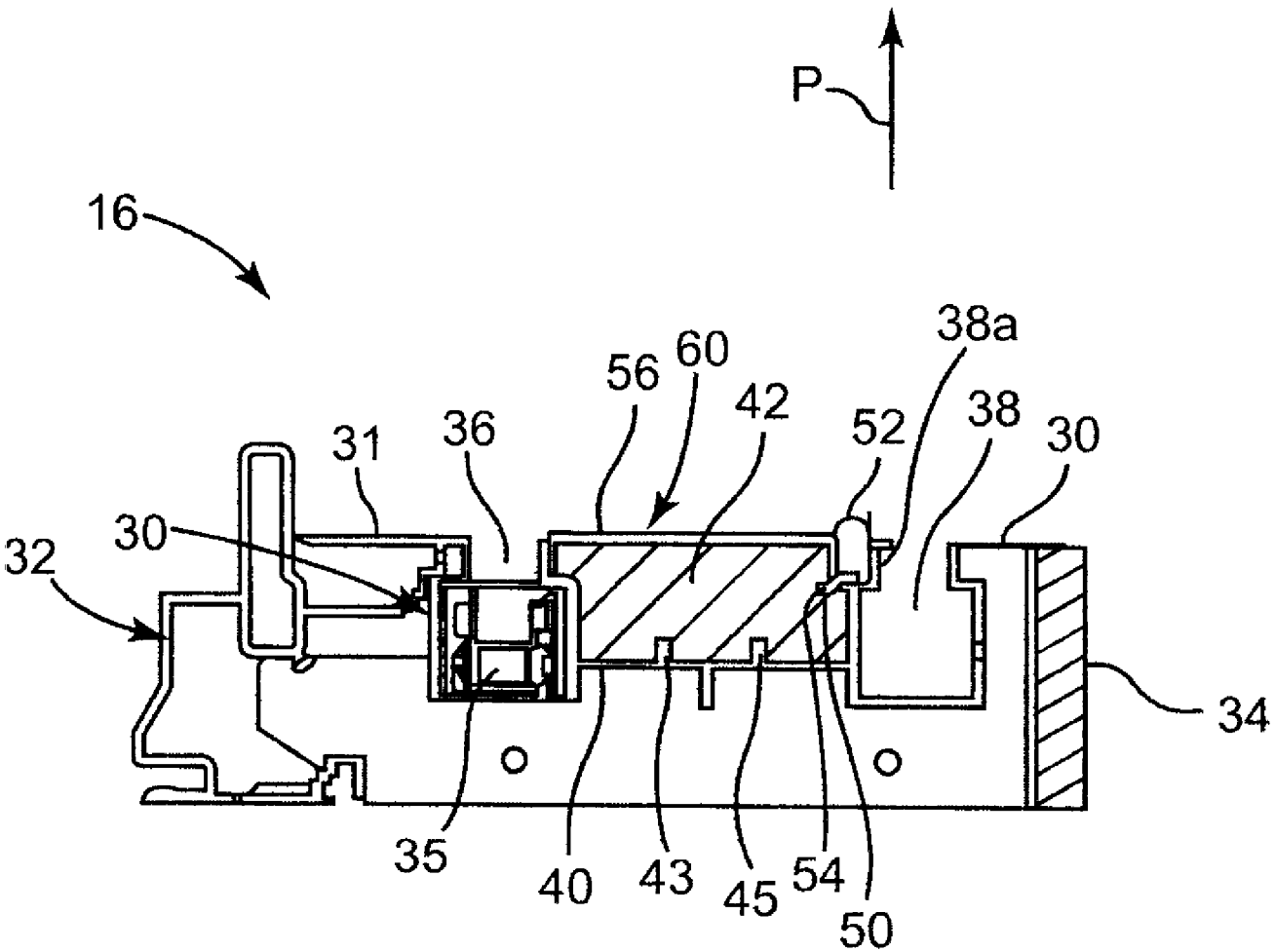
FIG. 2*a* illustrates a cross sectional view taken along the lines 2A-2A of FIG. 1 showing a lower portion of an opposing side jamb of the window assembly.
Figure 2B:
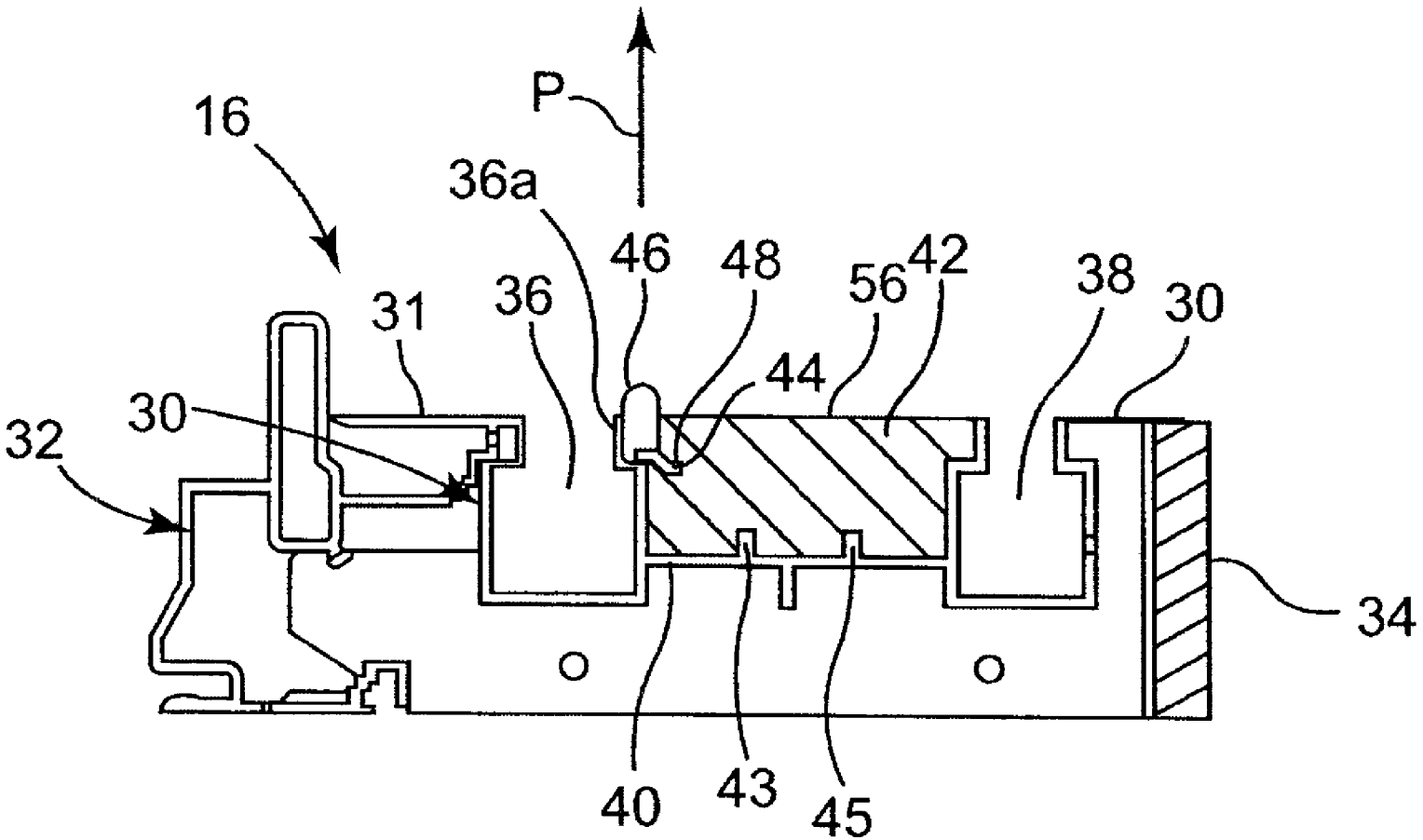
FIG. 2*b* illustrates a cross sectional view taken along the lines 2B-2B of FIG. 1 showing an upper portion of an opposing side jamb of the window assembly.
Figure 3:
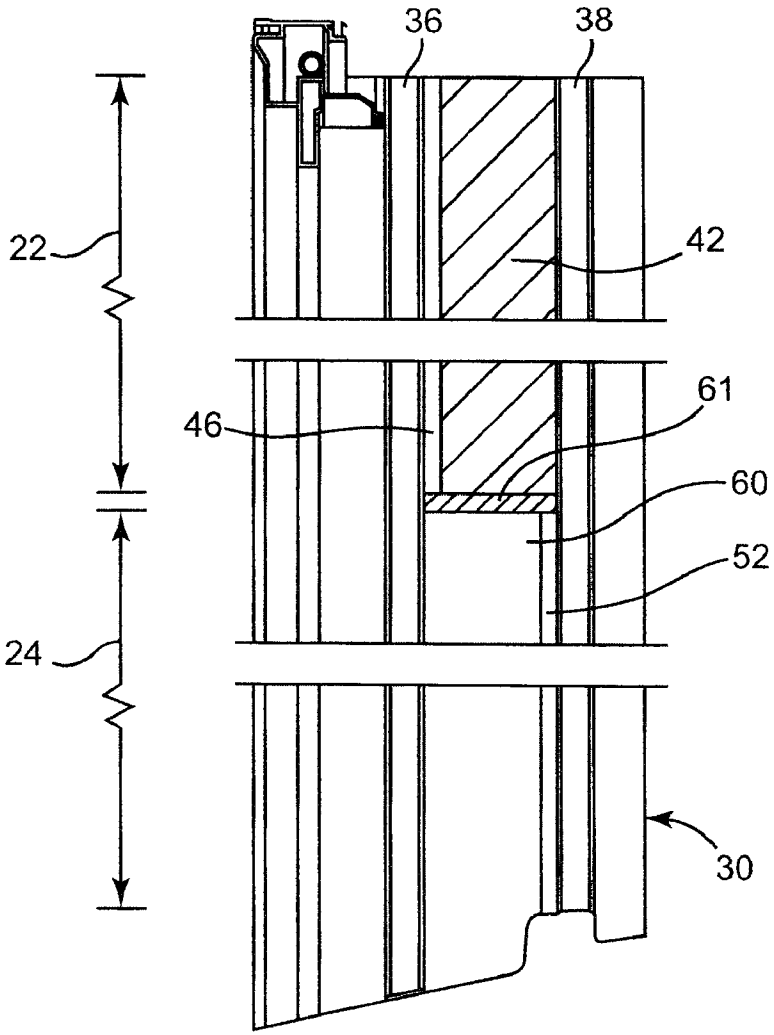
FIG. 3 illustrates a fragmented perspective view of the opposing side jamb illustrated in FIG. 1, as viewed from lines 3-3.

In the illustrated embodiment, the opposing side jambs 16 include the jamb liners 30 illustrated in FIGS. 2*a*, 2*b* and 3. FIG. 2*a* illustrates a sectional view of an upper portion of one of the opposing side jams 16 taken along lines 2A-2A in FIG. 1. FIG. 2*b* illustrates a sectional view of a lower portion of one of the opposing side jambs 16 taken along lines 2B-2B in FIG. 1. FIG. 3 illustrates a fragmented perspective view of the jamb liner 30 shown in FIGS. 2*a* and 2*b*, as viewed from lines 3-3 in FIG. 1.

Each jamb liner 30 has a jamb liner length 26 that is generally equal to a length of the opposing side jambs 16, as shown in FIG. 1. The jamb liners 30 of the opposing side jambs 16 are generally constructed as an extrusion from material such as for example metal or plastic. Suitable plastic materials include polyvinyl chloride or other rigid or semi-rigid thermoplastic or thermoset polymers. Any other suitable materials known to those skilled in the art may be used to form the jamb liners 30.

The jamb liners 30 of the window assembly 10 are each equipped with a jamb recess 40 that extends between the inner sash track 38 and the outer sash track 36 on each of the jamb liners 30. The sash tracks 36, 38 typically include sash interface hardware 35, such as a counterbalance or spring to assist in moving and retaining the sashes 12, 14 in the desired locations.

In the illustrated embodiment, the jamb recess 40 retains a jamb filler 42. Connectors 43, 45 releasably retain the jamb filler 42 in the jamb recess 40. The jamb filler 42 preferably forms a compressive or a snap-fit relationship with the connectors 43, 45. Consequently, the jamb filler 42 can be easily removed and replaced in the field. As used herein, "snap-fit" refers to a mechanical coupling that is achieved by elastic deformation of at least one of the two mating components.

The jamb filler 42 preferably has a length generally equal to the jamb liner length 26. As illustrated in FIGS. 2*a* and 2*b*, the jamb filler 30 is made of wood, the same material as inner trim 34 of the window assembly 10. The jamb filler 42 preferably substantially fills the jamb recess 40 to provide for a visually appealing side jamb 16. As described above, however, the jamb filler 42 may be formed of any suitable material.

Each jamb filler 42 preferably includes an inner weather stripping recess 50 and an outer weather stripping recess 44. The weather stripping recesses 50, 44 are preferably located on a side edge of the jamb filler 42. The weather stripping recesses 50, 44 are separated by the width of primary surface 56 on the jamb filler 42. As illustrated in FIGS. 2*a* and 2*b*, the inner weather stripping recess 50 maybe located in a lower portion of the jamb filler 42, while the outer weather stripping recess 44 is located in an upper portion of the jamb filler 42. Each outer and inner weather stripping recess 44, 50 is configured to secure an outer weather stripping 46 and an inner weather stripping 52, respectively.

The inner and outer weather stripping 52, 46 for sealing the sash assemblies preferably includes an elongated foam element, such as for example urethane, connected to a weather stripping base. As illustrated in FIG. 2*a* the inner weather stripping 52 includes an inner weather stripping base 54 that conforms to the inner weather stripping recess 50.

Similarly, in FIG. 2*b* the outer weather stripping 46 includes an outer weather stripping base 48 that conforms to the outer weather stripping recess 44. The weather stripping bases 48, 54 may include a non-foam element that is generally configured to conform to the inner and outer weather stripping recesses 50,44. In one embodiment, the weather stripping base 48, 54 includes a bayonet-type connector elements to form a secure engagement with the jamb filler 42.

In the embodiment illustrated in FIGS. 2*a* and 2*b*, the inner and outer weather stripping 52, 46 is preferably compressively secured between the jamb filler 42 and portions 36*a*, 38*a* of the inner and outer sash track, 38, 36, respectively. In the illustrated embodiment, the outer and inner weather stripping recess 44, 50 are generally parallel to the primary surface 56 of the jamb filler 42 and perpendicular to the portions 36*a*, 38*b*, respectively. In particular, the outer and inner weather stripping recess 44, 50 are generally perpendicular to pull direction P along which the weather stripping 46, 52 is likely to be removed. The pull direction P is typically perpendicular to the primary surface 56. Consequently, the weather stripping base 48, 54 is trapped in the recesses 44, 50. In the preferred embodiment, the weather stripping 46, 52 can not be removed unless the jamb filler 42 is removed from the jamb recess 40.

The inner weather stripping 52 generally has a length equal to the lower sash height 24 while the outer weather stripping 46 generally has a length equal to the upper sash height 26, as illustrated in FIG. 3. FIG. 3 also shows that the inner weather stripping 52 may be located in a lower portion of the inner weather stripping recess 50 while the outer weather stripping 46 may be located an upper portion of the outer weather stripping recess 44. The unused portions of the weather stripping recesses 44, 50 are hidden behind the portions 36*a*, 38*a* of the jamb liner 30.

In operation, as the upper sash 12 is lowered, the amount of surface area of the outer weather stripping 46 engaged with the upper sash 12 is reduced. Hence the fiction between the upper sash 12 and the weather stripping 46 is also reduced, allowing the upper sash 12 to move more easily. Similarly, as the lower sash 14 is raised, the amount of surface area of the inner weather stripping 52 engaged with the lower sash 14 is reduced. Hence the fiction between the lower sash 14 and the weather stripping 52 is also reduced, allowing the lower sash 14 to move more easily.

In the illustrated embodiment, primary exposed surface 56 of the jamb filler 42 is substantially unobstructed by either the inner or the outer weather stripping 52, 46. Although the exposed surface 56 is illustrated as planar, various aesthetic non-planar configurations are within the scope of the present invention. The exposed surface 56 can be located above, below, or co-planar with inner surfaces 31 of the jamb liner 30.

In the illustrated embodiment, the jamb filler 42 includes a primary exposed surface 56 that is substantially unobstructed by either the inner or outer weather stripping 50, 44. The primary exposed surface 56 may either be formed of the surface of the jamb filler 42, as illustrated in FIG. 2*b*, or it may include a protective cover 60 that covers the lower portions of the jamb filler 42, as illustrated in FIG. 3. The protective cover 60 can be a cladding, typically made of metal or plastic, a weather resistant coating, such as for example paint, stain, polyurethane, and the like. A check rail seal 61 is preferably located where the sashes 12, 14 meet in the closed position.

In the illustrated embodiment, the protective cover 60 on the lower portion of the side filler 42 is a cladding. The cladding 60 may be formed of any suitable material such as, for example, extruded plastic or extruded aluminum. In the preferred embodiment, the cladding 60 is formed of a material that is the same as, or provides the substantially the same appearance as, the outer trim 32 of the window assembly 10.

As illustrated in FIG. 2*b*, the upper portion of the jamb filler 42 preferably does not include a protective cover 60. Instead, the primary exposed surface 56 is simply an exposed surface of the jamb filler 42. In the preferred embodiment, the primary exposed surface 56 of the upper portion of the jamb filler 42 the same appearance as the inner trim 34 of the window assembly 10. In the preferred embodiment, the cladding 60 is formed of the same material as the outer trim 32 of the opposing side jambs 16 while the jamb filler 42 and the primary exposed surface 56 of the jamb filler 42, is formed of the same material as the inner trim 34.

All patents and patent applications disclosed herein, including those referred to in the Background of the Invention, are hereby incorporated by reference. It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims and their equivalents.

What is claimed is:

1. A double hung window assembly, comprising:

upper and lower sash assemblies each having a sash height;

opposing side jambs;

a pair of opposing jamb liners comprising a jamb liner length generally equal to a length of the opposing side jambs, sash tracks on each of the jamb liners securing the upper and lower assemblies to the opposing side jambs, and at least one jamb recess located between the sash tracks on each of the jamb liners;

a pair of jamb fillers each having a length generally equal to the jamb liner length and retained in each of the jamb recesses, each jamb filler having an outer weather stripping recess and an inner weather stripping recess;

an outer weather stripping having a length generally equal to the height of the upper sash assembly and attached in the outer weather stripping recess; and an inner weather stripping having a length generally equal to the height of the lower sash assembly and attached in the inner weather stripping recess, wherein the jamb filler comprises a primary exposed surface that is substantially unobstructed by the inner and outer weather stripping.

2. The window assembly of claim 1 wherein each jamb filler is releasably attached to one of the jamb recesses.

3. The window assembly of claim 1 wherein each jamb filler forms a compressive relationship with one of the jamb recesses.

4. The window assembly of claim 1 wherein the jamb filler substantially fills the jamb recess.

5. The window assembly of claim 1 wherein the jamb filler is formed of substantially the same material as an inner trim of the window assembly.

6. The window assembly of claim 1 wherein the jamb filler is formed of wood.

7. The window assembly of claim 1 wherein the inner and outer weather stripping recesses are located along a side edge of the jamb filler.

8. The window assembly of claim 1 wherein the inner and outer weather stripping recesses are generally perpendicular to a pull direction along which the weather stripping is removed.

9. The window assembly of claim 1 wherein the inner and outer weather stripping recesses are generally parallel to the primary exposed surface of the jamb filler.

10. The window assembly of claim 1 wherein the inner weather stripping recess is located in a lower portion of the jamb filler.

11. The window assembly of claim 1 wherein the outer weather stripping recess is located in an upper portion of the jamb filler.

12. The window assembly of claim 1 wherein a portion of the outer and inner weather stripping is compressively secured between the jamb filler and a portion of the jamb liner.

13. The window assembly of claim 1 wherein a portion of the outer and inner weather stripping is trapped between the jamb filler and a portion of the jamb liner.

14. The window assembly of claim 1 wherein the inner and outer weather stripping can not be removed from the jamb filler unless the jamb filler is removed from the jamb recess.

15. The window assembly of claim 1 comprising a protective cover attached to the jamb filler along a lower portion thereof and having a length generally the height of the lower sash.

16. The window assembly of claim 15 wherein the protective cover is substantially similar in appearance to an outer trim of the window assembly.

17. The window assembly of claim 15 wherein the protective cover is formed from one of plastic cladding, aluminum cladding, paint, polyurethane, and stain.

18. A double hung window assembly, comprising:

upper and lower sash assemblies each having a sash height;

opposing side jambs;

a pair of opposing jamb liners comprising a jamb liner length generally equal to a length of the opposing side jambs, sash tracks on each of the jamb liners securing the upper and lower assemblies to the opposing side jambs, and at least one jamb recess located between the sash tracks on each of the jamb liners;

a pair of jamb fillers each having a length generally equal to the jamb liner length and retained in each of the jamb recesses, each jamb filler having an outer weather stripping recess and an inner weather stripping recess;

an outer weather stripping having a length generally equal to the height of the upper sash assembly and attached in the outer weather stripping recess; and an inner weather stripping having a length generally equal to the height of the lower sash assembly and attached in the inner weather stripping recess, a portion of the outer and inner weather stripping compressively secured between the jamb filler and a portion of the jamb liner.

19. A method of manufacturing a double hung window assembly of claim 1, comprising the steps of:

positioning the pair of opposing jamb liners in the opposing side jambs of the window assembly, the jamb liner having said length generally equal to the length of the opposing side jambs;

positioning the upper and lower sash assemblies each having said sash height in sash tracks formed in the opposing jamb liners;

providing the pair of jamb fillers each having said length generally equal to the jamb liner length, each jamb filler having said outer weather stripping recess and said inner weather stripping recess;

attaching the outer weather stripping having said length generally equal to the height of the upper sash assembly to the outer weather stripping recess;

attaching the inner weather stripping having said length generally equal to the height of the lower sash assembly to the inner weather stripping recess, wherein the jamb filler comprises the primary exposed surface that is substantially unobstructed by the inner and outer weather stripping; and releasably securing the jamb liner in the jamb recesses located between the sash tracks on each of the jamb liners.

20. The method of claim 19 comprising the step of compressively engaging the jamb filler with the jamb recess.

21. The method of claim 19 comprising the step of compressively securing a portion of the outer and inner weather stripping between the jamb filler and a portion of the jamb liner.

22. The method of claim 19 comprising the step of forming the inner and outer weather stripping recesses generally parallel to the primary exposed surface of the jamb filler.

23. The method of claim 19 comprising the step of forming the inner and outer weather stripping recesses generally perpendicular to a pull direction along which the weather stripping is removed.

24. The method of claim 19 comprising locating the inner weather stripping recess only along a lower portion of the jamb filler.

25. The method of claim 19 comprising the step of locating the outer weather stripping only along an upper portion of the jamb filler.

26. The method of claim 19 comprising the step of removing the jamb filler from the jamb recess before removing the inner and outer weather stripping from the jamb filler.

27. The method of claim 19 comprising the step of attaching a protective coating to a lower portion of the jamb filler along a length generally equal to the height of the lower sash.

28. The method of claim 27 comprising the step of forming the protective coating with substantially the same appearance to outer trim of the window assembly.

29. The method of claim 27 comprising the step of forming the protective from one of plastic cladding, aluminum cladding, paint, polyurethane, and stain.

* * * * *